US005618192A

United States Patent [19]

Drury

[11] Patent Number: 5,618,192

[45] Date of Patent: Apr. 8, 1997

[54] FLEXIBLE CONDUCTIVE TRACK

[75] Inventor: Lee Drury, Woollahra, Australia

[73] Assignee: Mass International Pty. Ltd., Sydney, Australia

[21] Appl. No.: 412,941

[22] Filed: Mar. 29, 1995

Related U.S. Application Data

[63] Continuation-in-part of Ser. No. 193,074, filed as PCT/AU92/00414, Aug. 5, 1992, abandoned.

[30] Foreign Application Priority Data

| | | | |
|---|---|---|---|
| Aug. 5, 1991 | [AU] | Australia | PK7592 |
| Dec. 20, 1991 | [AU] | Australia | PL0139 |
| Feb. 11, 1992 | [AU] | Australia | PL0816 |
| Jul. 2, 1992 | [AU] | Australia | PL3311 |

[51] Int. Cl.[6] ..... H01R 25/00

[52] U.S. Cl. ..... 439/110; 439/113; 439/118

[58] Field of Search ..... 439/110, 111, 439/113, 117, 118, 119, 121, 122, 332, 334, 337

[56] References Cited

U.S. PATENT DOCUMENTS

| | | | |
|---|---|---|---|
| 2,062,752 | 12/1936 | Kindberg | 439/111 OR |
| 2,105,833 | 1/1938 | Feuer et al. | 439/111 OR |
| 2,175,245 | 10/1939 | Brockman | 439/111 OR |
| 2,240,180 | 4/1941 | Frank | 439/111 OR |
| 3,089,042 | 5/1963 | Hickey et al. | 439/110 X |

FOREIGN PATENT DOCUMENTS

| | | | |
|---|---|---|---|
| 0558476 | 6/1958 | Canada | 439/119 OR |

*Primary Examiner*—P. Austin Bradley
*Assistant Examiner*—Daniel Wittels
*Attorney, Agent, or Firm*—Michael D. Bednarek; Kilpatrick & Cody

[57] ABSTRACT

The invention provides an electrical distribution system for skirting boards having an extruded housing which houses a conductor assembly so as to form a longitudinally extending access channel in which, at any location, a connector plug can be inserted. The conductor assembly has a number of slots in opposite faces and in which in one face bus conductors are located. The width of the slots decrease when the conductor assembly is bent so that the distribution system does not have to be cut at wall corners. The connector plug is rotated through 90 degrees to establish electrical contact.

20 Claims, 16 Drawing Sheets

FLEXIBLE CONDUCTIVE TRACK

This application is a continuation-in-part of application Ser. No. 08/193,074, filed as PCT/AU92/00414 Aug. 5, 1992 now abandoned.

TECHNICAL FIELD

This invention relates to an electrical conductor assembly and an electrical distribution system having a flexible conductive track.

The invention has particular but not exclusive application to an electrical conductor assembly and an electrical distribution system for use in walls, floors, ceilings, skirting boards and the like for distribution of electrical power and/of electrical signals.

BACKGROUND ART

Known prior art flexible conductors include U.S. Pat. No. 2,062,752—Kindberg which has wires forming the power lines embedded in two slits in a rubber housing. This results in only a small area of contact—nominally a "point contact"—between the tines of a power take off device and the conductors of the track with resultant problems with connection failure. Further the configuration of the housing does not readily allow for bending of the track in a lateral direction with respect to the slots. It being necessary to cut one or more notches to facilitate the bending oft the track around a corner.

U.S. Pat. No. 2,105,833—Freuer, et al shows a track which comprises a flexible moulding having two slits with a wire embedded in each slit. Again only a "point contact" with a tine of a power take off device would occur. Further the moulding does not appear to be able to bend laterally to the slits.

U.S. Pat. No. 2,175,245—Brockman whilst showing a flexible track, requires that the contacts are in the form of separate jaws, and also only shows a shape of housing which does not permit bending of the track laterally, but only allows bending with the ingress to the contacts being internal or external to the bend direction.

U.S. Pat. No. 2,240,180—Frank describes a flexible track but does not show a track which can bend laterally. Further the contacts have individual jaws to assist bending with the ingress to the contacts being internal or external to the bend direction.

In International patent Application No PCT/SE86/00579 there is described a flexible conductor strip having an elongated wire conductor surrounded by a thin insulation layer with an elongaged slot extending through the insulation layer to provide access to the conductor. This conductor strip only provides a small area of contact between the conductor and a take off device. Further, because of the small diameter of the conductor strip, the strip will twist during bending resulting in the slot twisting out of position.

Systems utilizing the above tracks as described in the abovementioned references do not allow a secure connection to the conductors in the track; but rely on a straight "push in" of the tines of the power take off into the slits containing the contacts, generally relying upon the resilience of the material of the house to retain engagement.

A rigid supply rail system having bus bars located in vertically extending elongated channels is described in International Patent Application PCT/AU86/00252. This reference provides a single small diameter elongate conductor located adjacent to the roof of the channels. Access to the channels is by way of an elongated opening located on the side wall adjacent the base of the rail. Thus the connection of the take off device is dependent on the small area of contact between the tine of the take off device and the elongated conductor. Further, when a change of direction is required for the supply rail, a corner adaptor is required to be connected between the adjacent supply rails. Therefore, because of the connections between straight rail sections and corner adaptors, an increase in impedence of the supply rail system occurs. Therefore if a high fidelity signal is required, this system could cause interference or noise, distorting the signal.

The use of a rigid supply rail is also shown in U.S. Pat. Nos. 4,243,284—Humphreys, U.S. Pat. No. 4,462,650—Humphreys and U.S. Pat. No. 4,479,687—Humphreys et al. These references show a limited access to the conductors by way of discrete doorways with resultant complex arrangements for opening and closing.

SUMMARY OF INVENTION

The present invention aims to provide an alternative electrical conductor assembly and an electrical distribution system.

This invention in one,aspect resides broadly in an electrical distribution system including:

- a support housing having at least one longitudinally extending chamber for receiving and supporting an electrical conductor assembly;
- an electrical conductor assembly located in the chamber and spaced from a wall of the chamber to define a substantially continuous longitudinally extending access channel therewith, the conductor assembly including:
  - an elongage flexible insulated housing having a plurality of longitudinally extending substantially parallel slots extending inwardly from one face thereof and forming insulation means therebetween; and at least one longitudinally extending slot extending inwardly from a substantially opposite face thereof, the slot being substantially parallel to the plurality of slots, and
  - elongate flexible conductor means located in at least one of the slots in the one face;
  - the arrangement being such that the width of the slots decrease when the conductor assembly is bent in a plane substantially perpendicular to the plane of the parallel slots; and
- at least one plug assembly having a plurality of plug conductors for establishing electrical contact with the conductor means, the arrangement being such that the plug conductors are receivable within the access channel to prevent electrical contact being established and are rotatable within the access channel to establish electrical contact.

In a preferred embodiment the plug assembly abuts the support housing and includes a projecting member receivable within the access channel when the plug assembly abuts the support housing, the plug conductors extending radially from the projecting member. Preferably the plug conductors include tines, recess means being located between the tines for closely receiving the insulating means.

The insulated housing may include a first longitudinally extending slot located substantially centrally in the opposite face and second and third longitudinally extending slots located off-centre in the one face. A fourth longitudinally extending slot may be located substantially centrally in the one face.

It is preferred that the chamber includes an engagement member for lockingly engaging in the first slot for supporting the insulated housing. Alternatively, or additionally, the chamber may include rib or shoulder means for supporting the insulated housing. Suitably the slots in the one face include support means for supporting the conductor means. The housing may be formed by any suitable means but it is preferred that the insulated housing is an extrusion.

In one preferred embodiment the conductor assembly includes a flexible elongate blade member in electrical contact with the conductor means for closely receiving a plug conductor and establishing electrical contact therewith. Suitably the elongate blade member is substantially U-shaped in cross-section and has a pair of opposed and inwardly biased substantially arcuate arms, the closed portion of the blade member housing the conductor means. It is preferred that the elongate blade member has a plurality of spaced cut-outs located along the closed portion.

In another preferred embodiment the plug conductors of the plug assembly have socket means for establishing electrical contact with a respective conductor means.

It is preferred that one of the plug conductors makes electrical connection with an earthed conductor in the conductor assembly upon rotation of the plug assembly before the others of the plug conductors make electrical connection respectively with the others of the conductor means.

It is also preferred that the plug assembly includes rotation limiting means for preventing rotation of the plug assembly beyond an orientation wherein the plug conductors are substantially perpendicular to the conductor means. The rotation limiting means can be a cam having stop means. Suitably the cam is a peripheral flange on the support member and the stop means is a tangential extension of the peripheral portion of the flange.

The plug assembly may include a guard assembly pivotally mounted on the support member for pivoting from a position substantially encompassing the plug conductors upon engagement of the guard assembly with the conductor assembly upon rotation of the plug assembly. Suitably the rotation limiting means includes a pin and a slot, one of which is associated with the guard assembly for rotation therewith.

In another aspect this invention resides broadly in an electrical conductor assembly including:

an elongage flexible insulated housing having a plurality of longitudinally extending substantially parallel slots extending inwardly from one face thereof and forming insulation means therebetween, and at least one longitudinally extending slot extending inwardly from a substantially opposite face thereof and being substantially parallel to the plurality of slots; and elongate flexible conductor means located in at least one of the slots in the one face;

the arrangement being such that the width of the slots decrease when the conductor assembly is bent in a plane substantially perpendicular to the plane of the parallel slots.

DESCRIPTION OF THE DRAWINGS

In order that this invention may be more easily understood and put into practical effect, reference will now be made to the accompanying drawings which illustrate a preferred embodiment of the invention, wherein:

FIG. 31 illustrates an electrical distribution assembly located in a ceiling for track lighting or the like.

DESCRIPTION OF THE PREFERRED EMBODIMENTS

Figure 1:
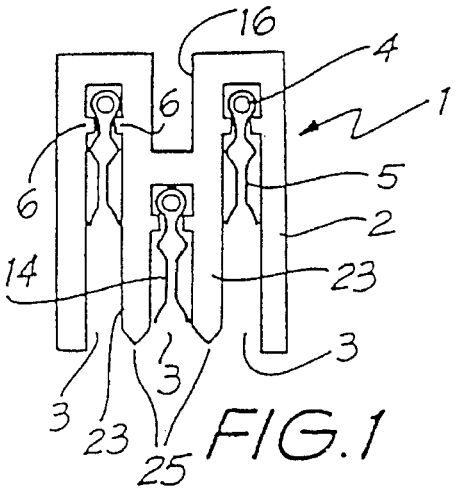
FIG. 1 illustrates an end view of a flexible conductive track according to one embodiment of the present invention.

As shown in FIG. 1 a flexible conductive track 1, according to one embodiment of the present invention, comprises a flexible insulative plastics housing 2 of constant cross-section. This housing is substantially rectangular in shape with three recesses 3 open to one side of the housing.

A conductor 4 in the form of a copper wire is held in the bottom of each recess. Affixed to the wire 4 along the whole length of the wire is a conductive blade 5 which is conductively bonded to the wire 4 to form a double spring blade contact 5. In the flexible conductive track, as shown in FIG. 1, the wire 4 is held in the recesses by shoulders 6 located adjacent the bottom of each recess 3.

The blade means can be a single blade with biasing means formed integrally with the walls of the recess to urge the tines of a take off unit into intimate contact with the blade 5. Further, the wire 4 and conductive blade 5 can be moulded into the housing wall by means of cross-head extrusion, when the housing is extruded.

Figure 2:
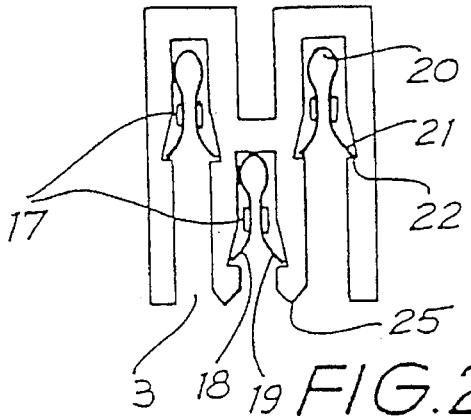
FIG. 2 shows an end view of a further embodiment of a flexible conductive track according to the present invention.

As shown in FIG. 2 a further embodiment of the flexible conductive track of the present invention comprises three recesses 3 with an elongated conductor 17 connected by pressure welding to arm 18 or 19, or both, if a bifurcated contact spring 20, which extends longitudinally along the length of the recesses 3. The contact spring 20 is held in the recess 3 by the free ends 21 of contact spring 20 resiliently bearing on shoulders 22 of the recesses 3 or held in the recess by crosshead extrusion. The contact spring 20 may provide both the spring action and conductivity in the single form.

Both flexible tracks 1, as shown in FIGS. 1 and 2, have a recess 16 located on the face opposite to the first face. This extends along the length of the track and enhances the flexibility of the track.

Figure 3:
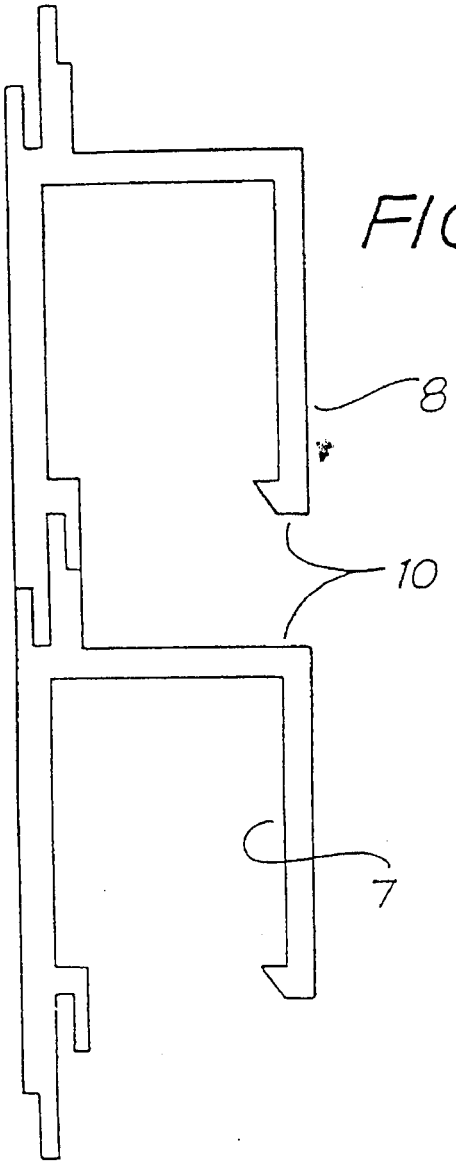
FIG. 3 illustrates an end view of one embodiment of a support housing to support the conductive track of FIGF. 1 or 2.

A suitable housing 8, as shown in FIG. 3, can be affixed to the wall of an area, where the system of the present invention is to be used. A single continuous length of a flexible conductive track 91, as illustrated in FIGS. 1 or 2, for example, is fitted into the channel 7 of the housing 8. The channel 7 is configured to hold the conductive track 91 such that open ends of the recesses 3 face downwardly.

Figure 4:
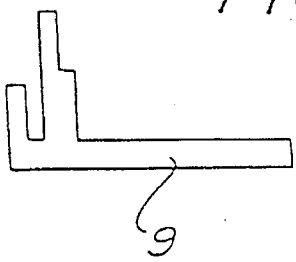
FIG. 4 illustrates a base adapted to be fitted to the housing of FIG. 3.
Figure 7:
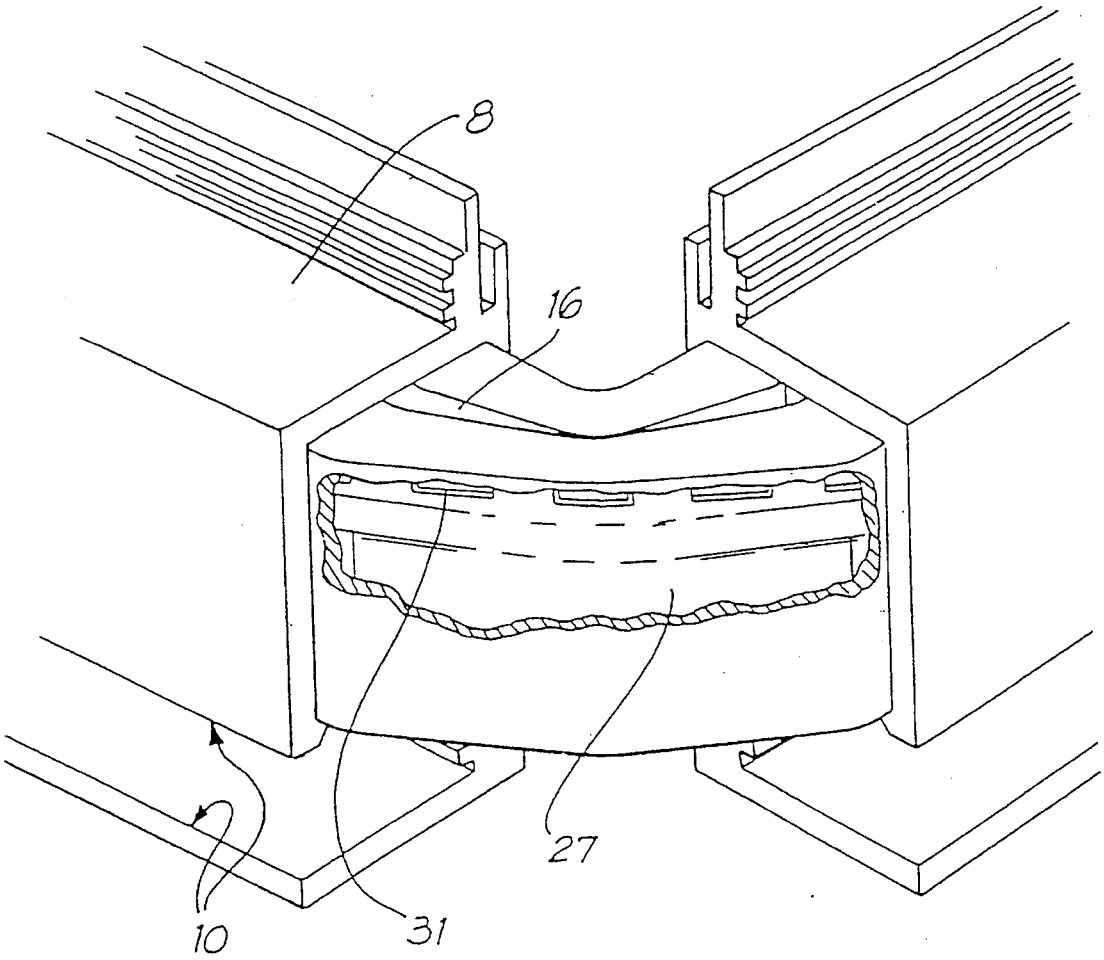
FIG. 7 illustrates one embodiment of the supply system according to the present invention (with the corner adaptor removed) and cutaway on the flexible track.
Figure 8:
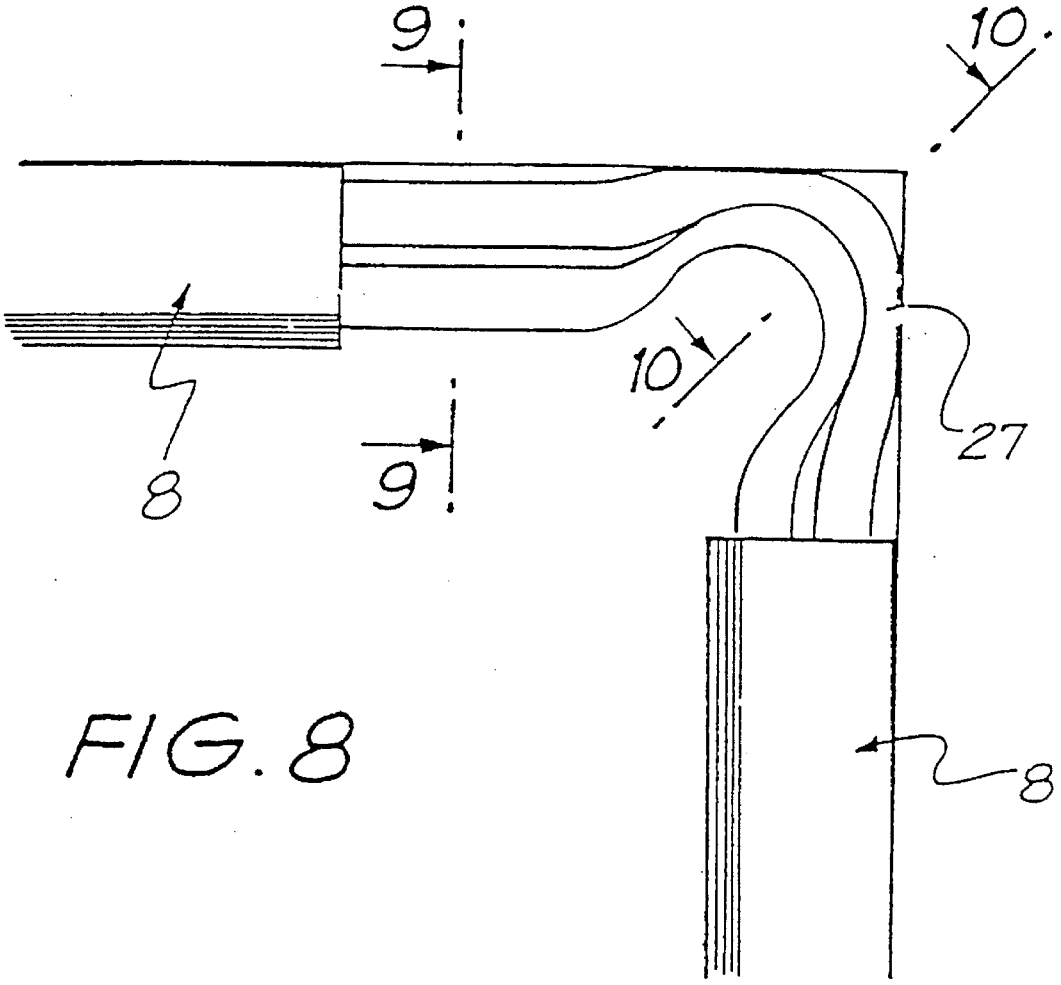
FIG. 8 shows a plan view of the system illustrated in FIG. 7 to show the resultant configuration of one embodiment of the flexible track of the present invention during bending of the track.
Figure 9:
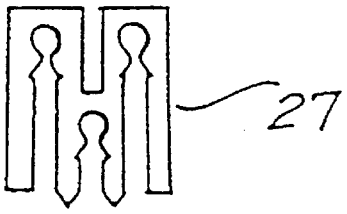
FIG. 9 shows the section view taken in the direction of arrows 9—9 in FIG. 8.
Figure 10:
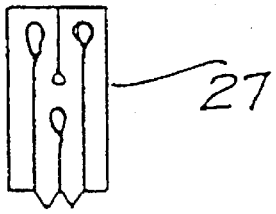
FIG. 10 shows a section view taken in the direction of arrows 10—10 in FIG. 8.

The base 9 as shown in FIG. 4 closes the bottom of the housing 8, leaving an elongated side access opening 10 which extends along the entire length of the housing 8, as shown in FIG. 7. Connection to the wires therefore can be made at any position along the length of the conductive track 1.

When the flexible track 1 is laterally bent around a corner as shownin FIGS. 7, 8, 9 and 10, the recesses 16 and 3 collapse to allow lateral bending.

Figure 5:
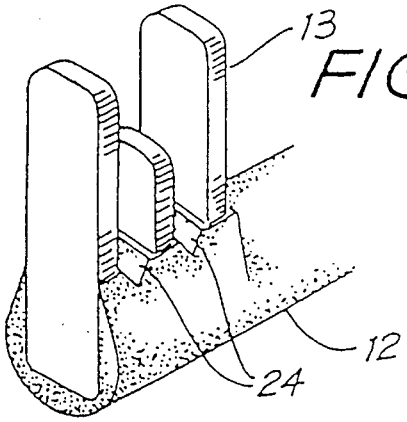
FIG. 5 illustrates a connection member of a take off device according to one embodiment of the present invention.
Figure 6:
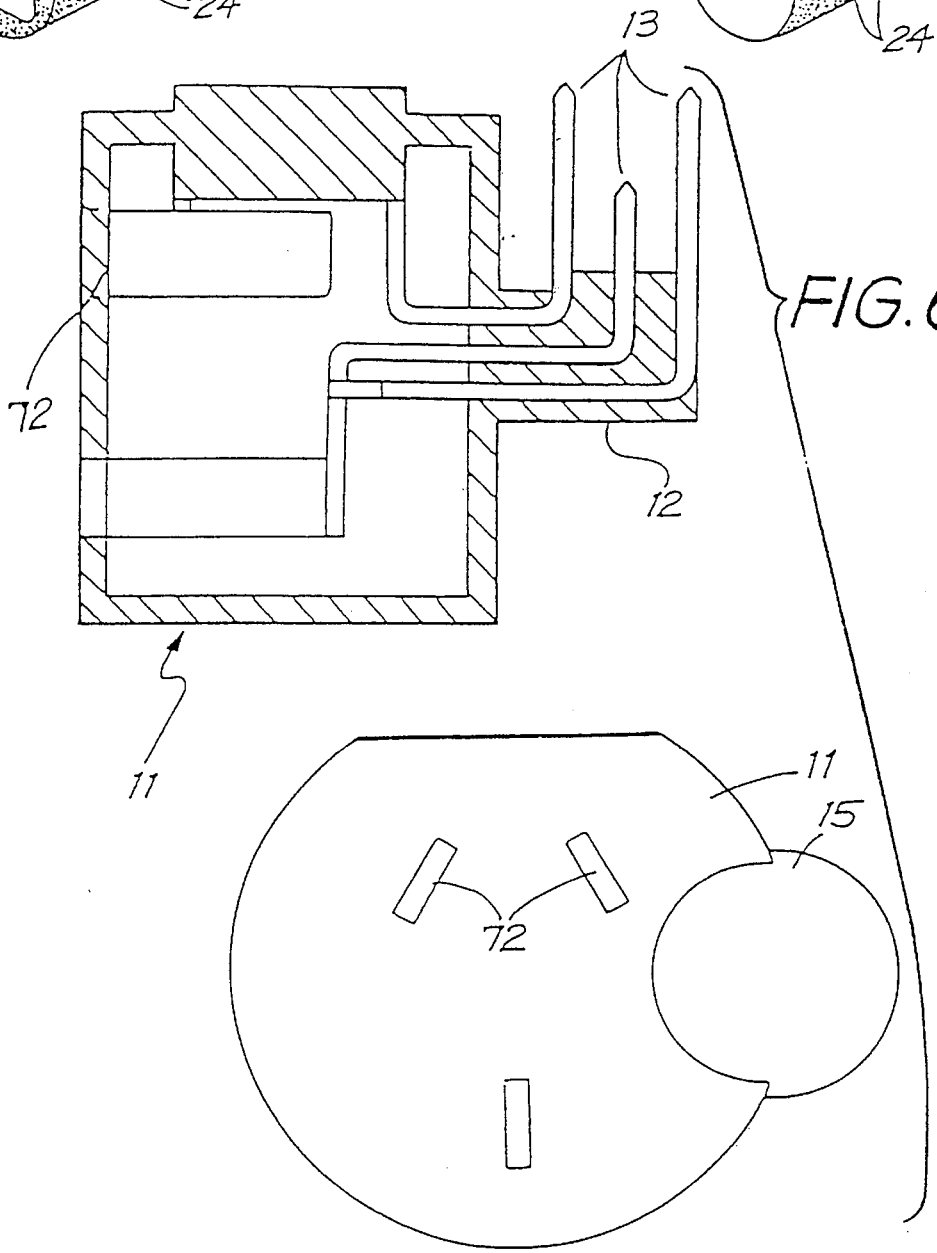
FIG. 6 illustrates a take off device according to one embodiment of the present invention.

A take off unit or plug assembly in the form of a power point is shown in FIG. 6. The power point 11 has a projection 12 extending from the back with one or more tines 13 extending radially therefrom. A view of the projection is shown in FIG. 5. To connect the power point 11 to the conductive strip 1, the tines 13 are aligned with the opening 10 and the projection 12 inserted into the opening 10 and the power point 11 rotated such that the tines 13 engage the respective blades 5 in the recesses 3. Because of the double blade spring construction, the blades 5 are urged into intimate engagement with each side of the tines 13 such that both flat areas 14, provide a relatively large contact area.

To further inhibit arcing between adjacent tines 13, when connected to the conductors/blades 5 in the flexible conductive track 1, the walls 23 of the housing 8 have their free ends 25 configured to mate with recesses 24 on the projection 12, isolating each tine 13 from the others.

Figure 5A:
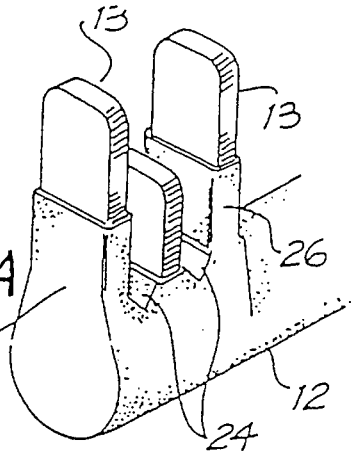
FIG. 5A illustrates a further form of a connection member according to another embodiment of the present invention.

Alterantively as shown in FIG. 5A, part of the length of one or more of the tines 13 can be sheathed in plastics, with or without the recesses 24, such that upon insertion of the tine into the recess 3, the plastics sheath 26 extends into the recess 3 to inhibit any arcing or discharging between the tines 13.

The powerpoint 11, as shown in FIG. 6, comprises a combined locking means and an on/off switch 15 to secure the powerpoint to the housing 8, wherein when the powerpoint 11 is rotated, after the insertion of the tines 13 into the opening 10, power is only available to the external output 72 upon manual operation of the locking means 15.

In another embodiment the projection 12 may be moulded directly to a power lead.

If required a cover strip could be used to seal the opening 10.

As shown in FIG. 3, the housing can comprise two channels one for telecommunication and one for power. However any number of channels could be used, for example one respectively for power, stereo systems, computer lines, gas, optical fibres etc.

The flexible conductive strip can be of any suitable configuration and have any number of recesses.

Figure 11:
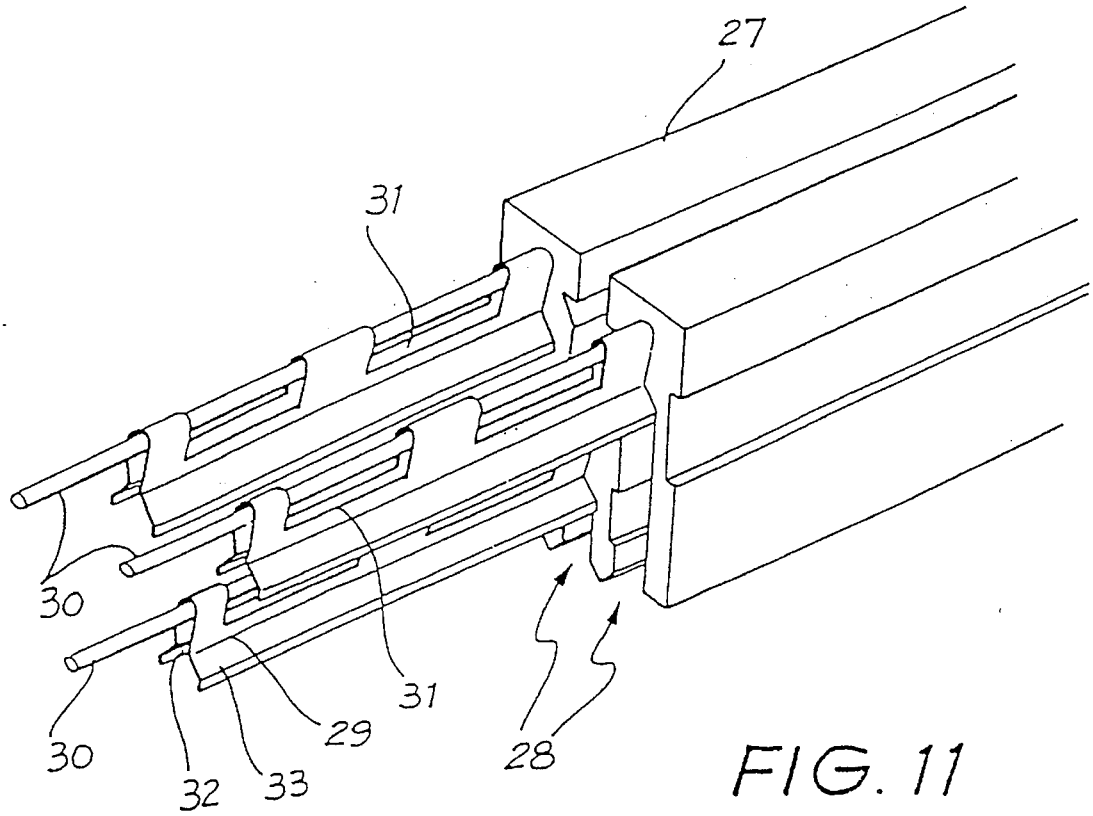
FIG. 11 illustrates another embodiment of the flexible track of the present invention.

To assist in the lateral bending of the flexible track an embodiment as shown in FIG. 11 can be used.

In the flexible insulative housing 27 are located three recesses 28 similar to those described previously which each contain a conductive blade 29 as shown in FIG. 11. A conductor 30 may be connected to the arcuate end of the connector plug blades 29. The conductor 30 could be standard copper wiring while the blade 29 could be formed of phosphorous bronze. Alternatively, the conductive blade 29 could be constructed so as to be used on its own, without the necessity of the additional conductor in the form of a copper wire 30.

At preselected positions along the length of the conductive blade 29, cutouts 31 are located along its length. These cutouts 31 do not extend into the contact area 32 of the arms 33 of the conductive blade. These cutouts 31 enhance the flexibility of the conductive blades 29 and hence the flexible conductive tracks 27 into which they are inserted.

Figure 12:
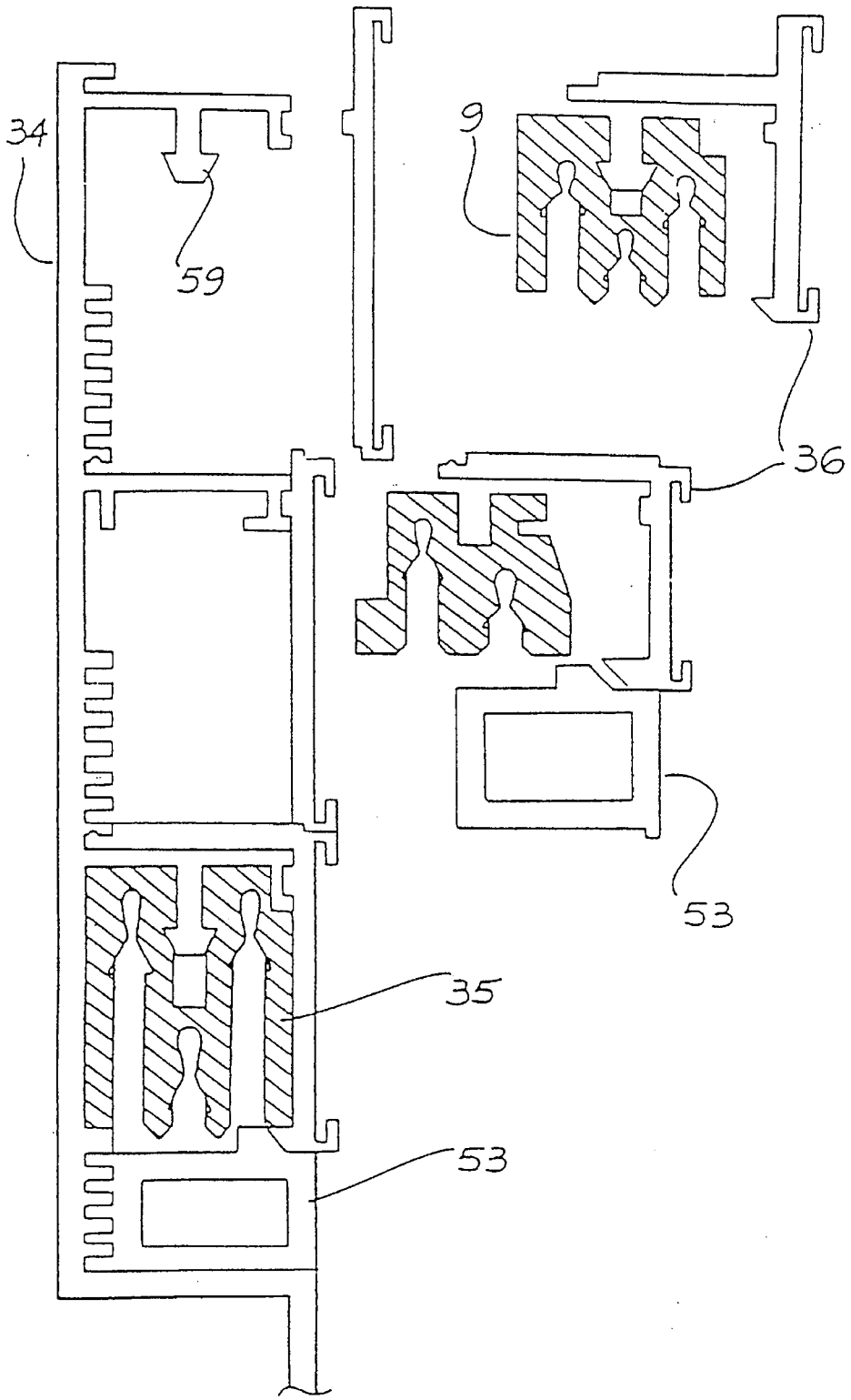
FIG. 12 illustrates another embodiment of the tracking system according to the present invention.

Additional as shown in FIG. 12, the housing 34 used to contain the flexible insulative track 35 can have external fittings 36 for the affixing of suitable colour strips not shown.

Figure 13:
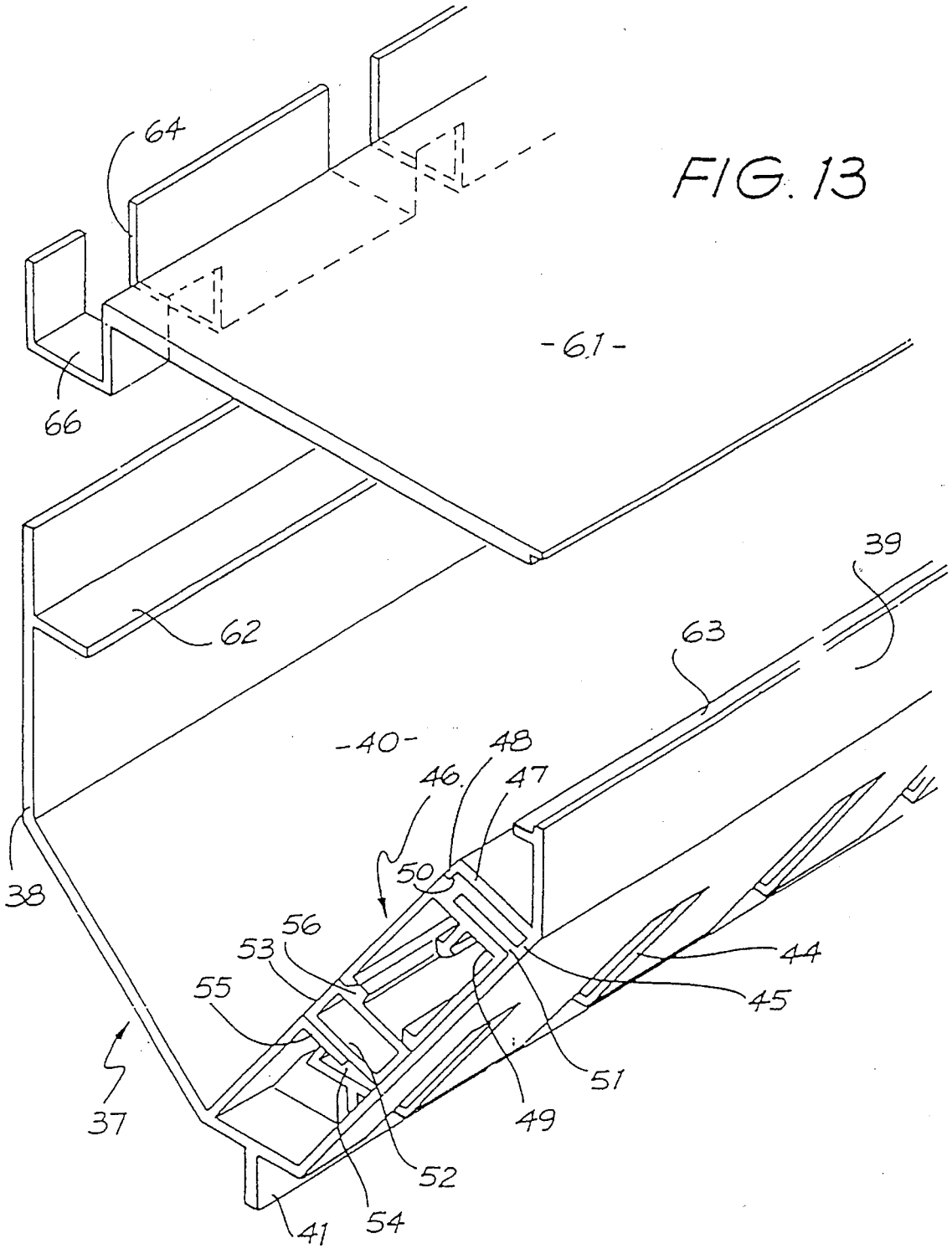
FIG. 13 illustrates a housing according to a further embodiment of the present invention.
Figure 14:
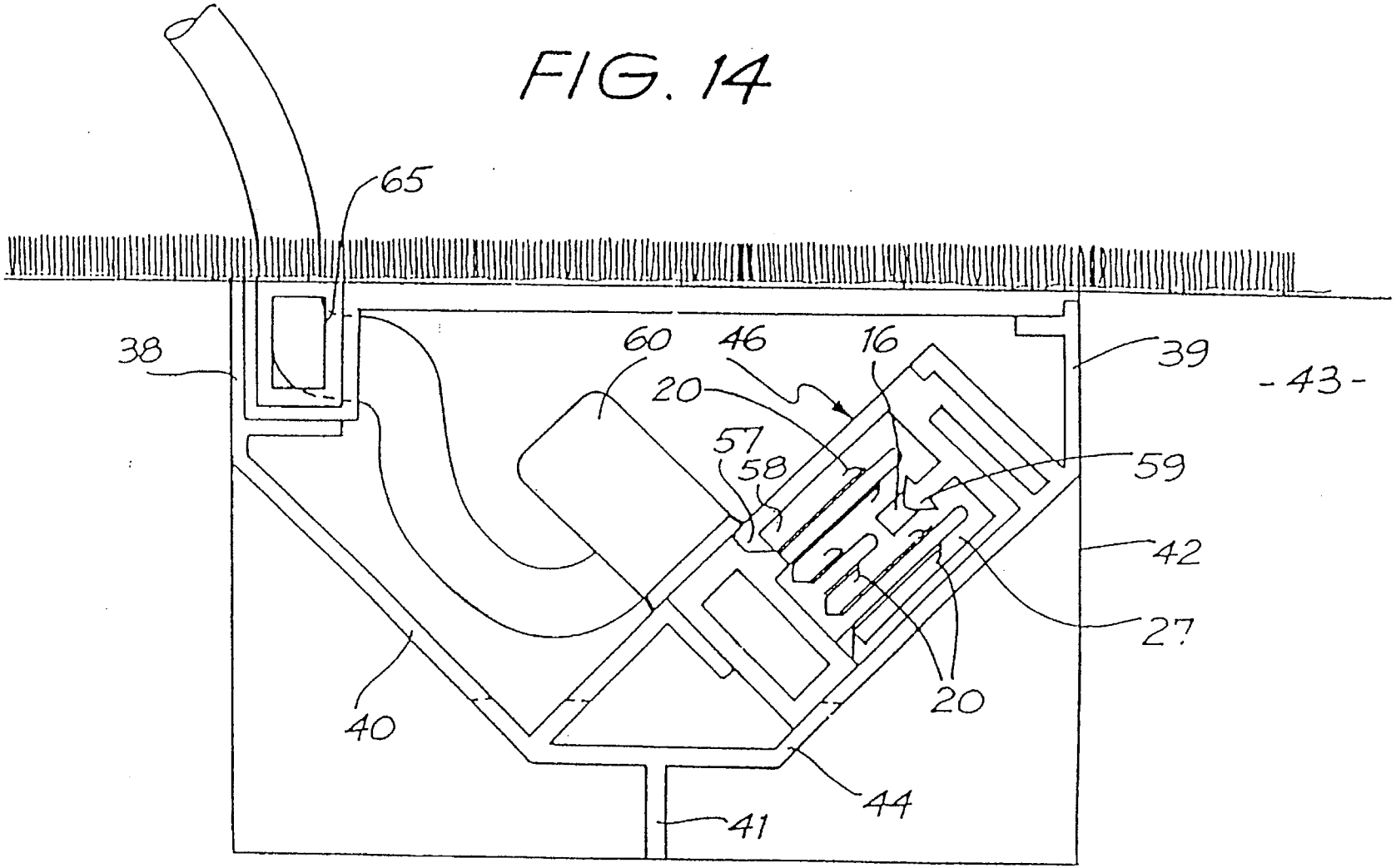
FIG. 14 illustrates a distribution system of one embodiment of the present invention utilizing the housing shown in FIG. 13.

One embodiment of a floor mounted system according to the present invention is shown in FIG. 13 comprises an open face housing 37, with two opposed side walls 38 and 39, and a channel portion 40, which has a base support 41. This embodiment is used to be inserted into a recess 42 in a floor 43 as shown in FIG. 14.

Located on the sides and base of the channel portion 40 are cutouts 44 to allow any moisture to drain out of the housing, and along and out of the floor recess 42.

A mounting means 45 is provided to hold an elongated cassette 46 therein. The mounting means 45 comprises two parallel projections, one 47 with a hook 48 located along the free end thereof.

The cassette 46 comprises an elongated recess 49, and a cutout 50 located at one end. The projection 51 is fitted into the recess 49 of the cassette 46 and the hook 48, because of the resilience of the material of the housing 37, snaps into the cutout 50 locking the cassette 46 in position. In the embodiment shown, the cassetee 46 has its open mouth 52 facing downwardly. A cover strip 53 can be inserted into the opening 54 below the cassette 46, where it rests on the elongated support 55 and locks into the cassette 46 by means of the projection 56 to close the mouth 52 of the cassette 46.

Fitted into the cassette 46 can be any form of conductive track, however preferably a flexible conductive track 1 shown in FIGS. 1 to 11 is used, as shown in FIG. 14, with the shoulders 57 of the cassette locking over the outer walls 58 of the flexible conductive track 1, with the barbed projection 59 engaging in the locating recess 16 of the flexible track 27.

A take off means 60 as described previously can be used to connect to the conductors 20, whereby power or the like is supplied external of the recess 42 as shown in FIG. 14. To close the recess a cover 61 rests on the top supports 62 and 63 of the housing 37, aligning flush with the flooring as shown in FIG. 14. The cover 61 has cutouts 64 located at appropriate positions along the cover 61 to allow for egress of suitable cable. These cutouts could be preformed or cutout when needed, and a cord cover strip 65 fits into the channel 66.

Figure 15:
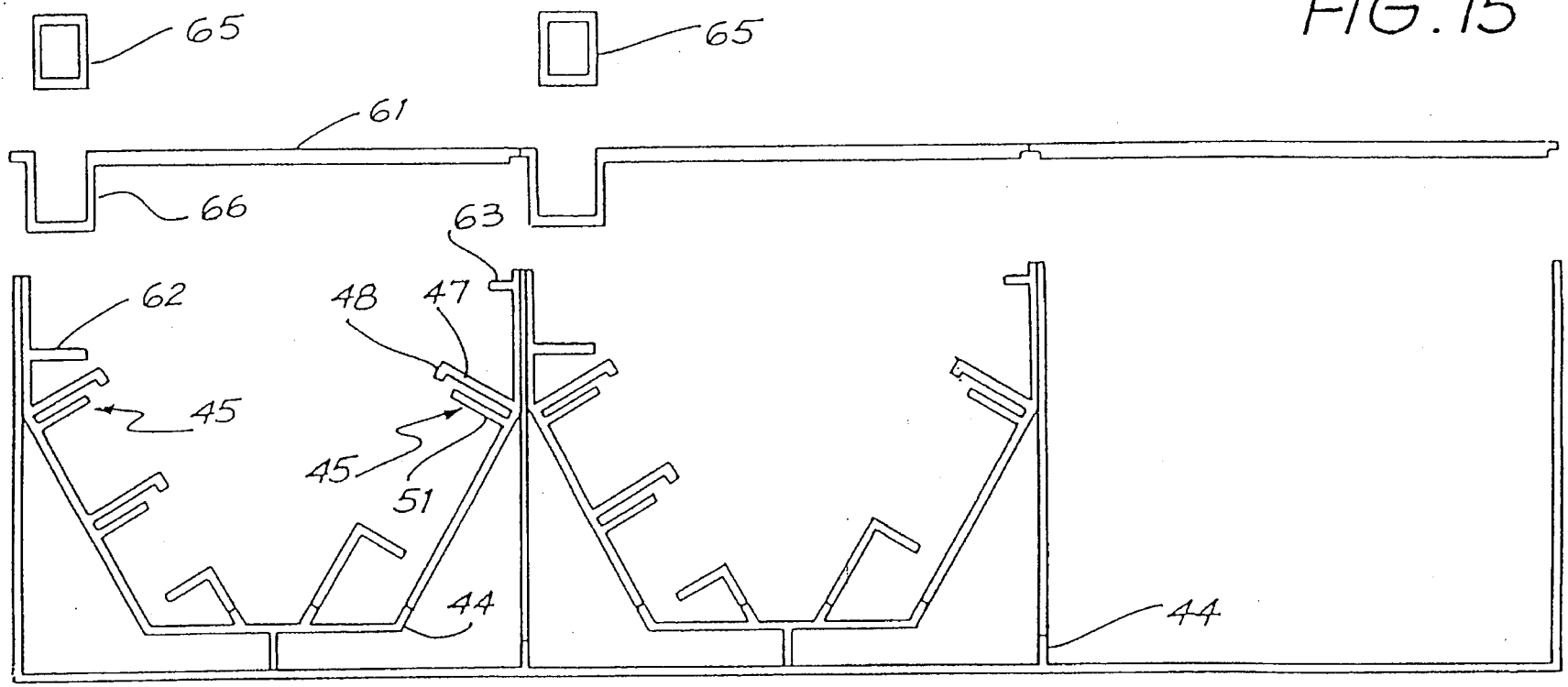
FIG. 15 illustrates a further embodiment of a housing usable in the present invention.

Other embodiments of the present invention are shown in FIG. 15 utilising multiple cassette mountings 45.

Figure 16:
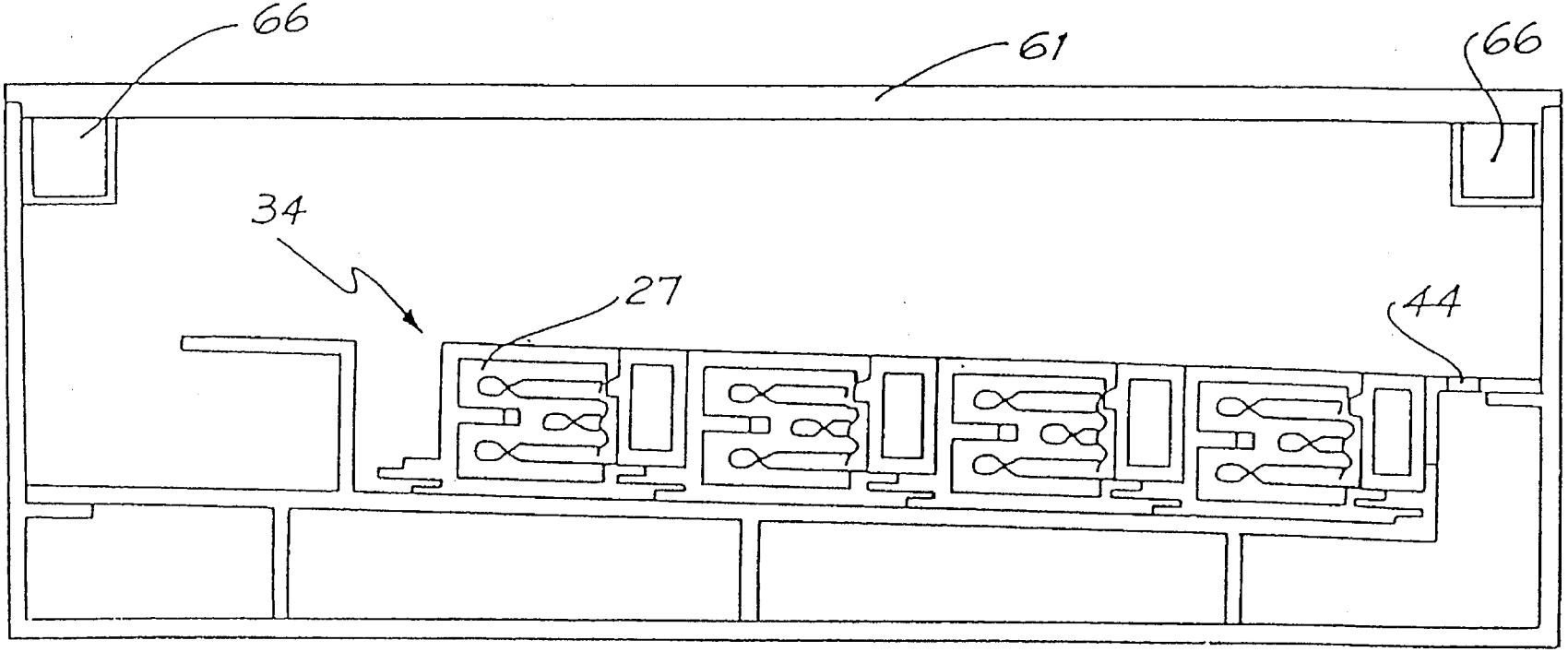
FIG. 16 illustrates a further embodiment of a housing usable in the present invention.

In FIG. 16 the housing 34 as illustrated in FIG. 12 can be used in a floor mounted arrangement similar to FIGS. 14 and 15.

Preferably the housing and cassettes are made from suitable plastics.

The cassette in use faces sideways with a suitable hinged or flapped cover slip covering its mouth to prevent ingress of contaminants.

Figure 17:
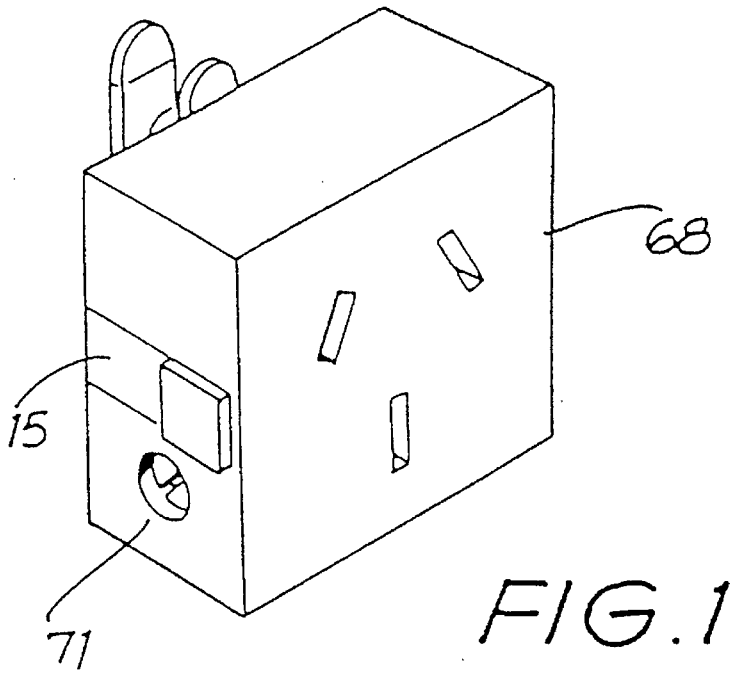
FIG. 17 illustrates an adaptor plug usable with the distribution systems of the present invention.
Figure 18:
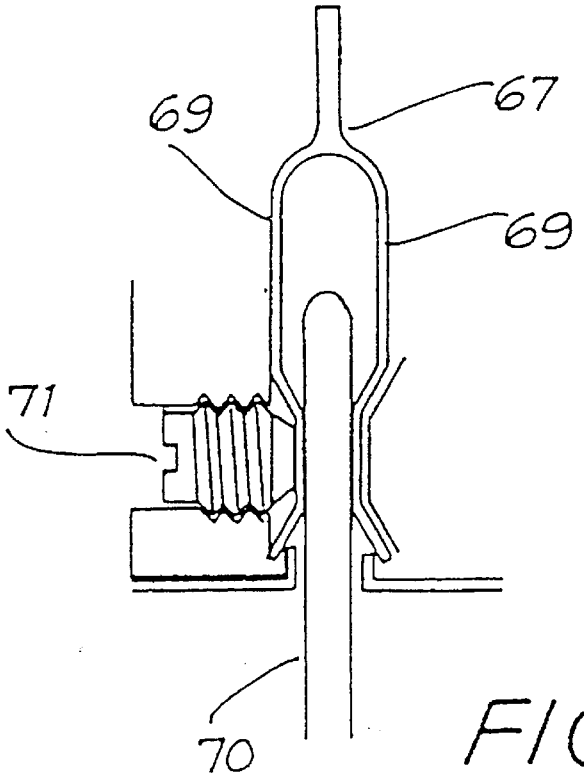
FIG. 18 shows a cutaway view of the adaptor plug illustrated in FIG. 16, showing the engagement of the connecting prong forming an electrical contact with an adaptor plus.
Figure 19:
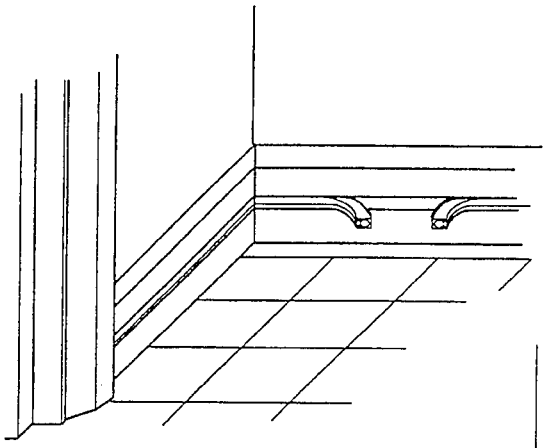
FIGS. 19 to 22 are perspective views of an electrical distribution system in accordance with the invention, illustrating the manner of establishing an electrical connection.
Figure 20:
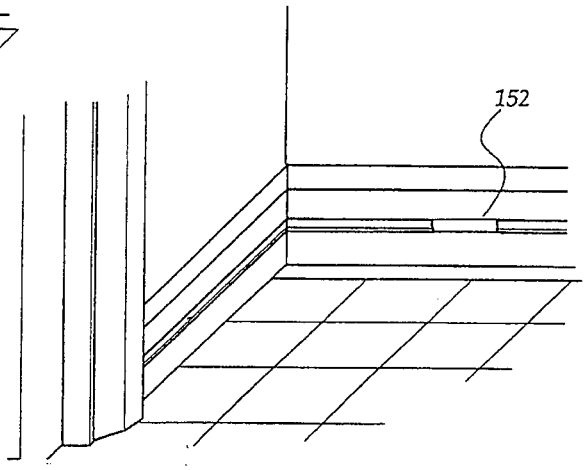

As is shown in FIGS. 17 and 18, the electrical connector 67 of the power point adaptor 68 comprises two arms 69 which are made of resilient metal. The prong 70 of an appliance (not shown) slides into engagement between the arms 69 and the screw 71 is tightened to urge the arms 69 into intimate contact with the prong 70. Sufficient pressure can be generated by the screw 71 to provide the equivalent of a fixed contact between the prong 70 and the arms 69.

In a further embodiment not shown, the prong could have a recess or bore into which the screw will engage to rigidly connect the prong to the electrical connectors.

This form of connection is not only limited to distribution systems, as before described, but can also be used with respect to standard power points and double connections.

Figure 23:
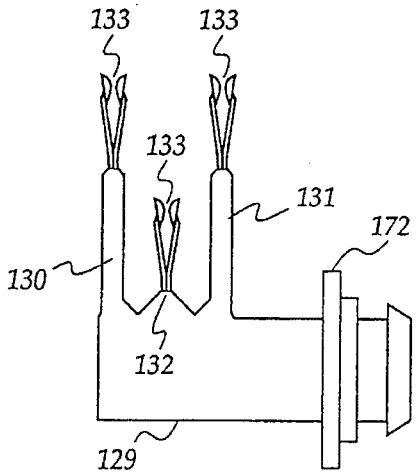
FIGS. 23 and 24 are side and end views respectively of one form of an electrical connector plug in accordance with the invention.
Figure 24:
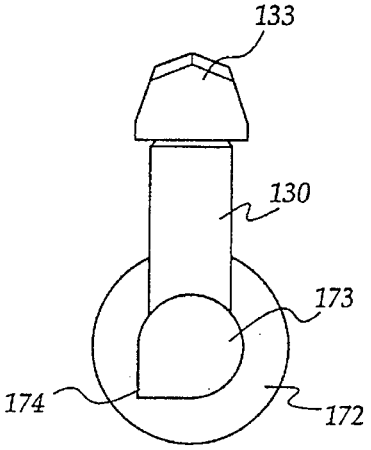

In another embodiment seen in FIGS. 23 and 24, a connector plug 129 engages the conductors in manner similar to that described above. Connector plug 129 has legs 130 to 132 carrying electrical connector sockets 133 which snap over conductors 171 as seem in FIG. 29. An abutment in the form of a peripheral flange 172 bears against the outer casing or skirting board and a flange 173 having a right-angle stop 174 prevents the electrical plug 129 overcentering as can be seen in FIG. 25.

Figure 26:
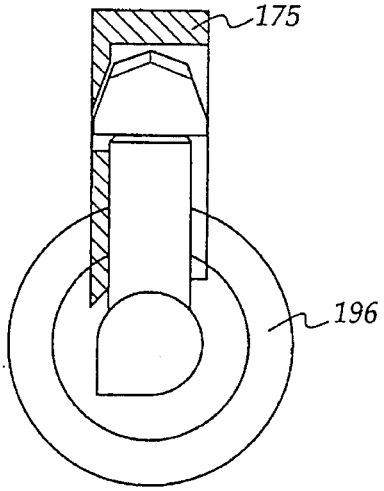
FIGS. 26 and 27 are end and side views respectively of another form of electrical connector plug in accordance with the invention.
Figure 27:
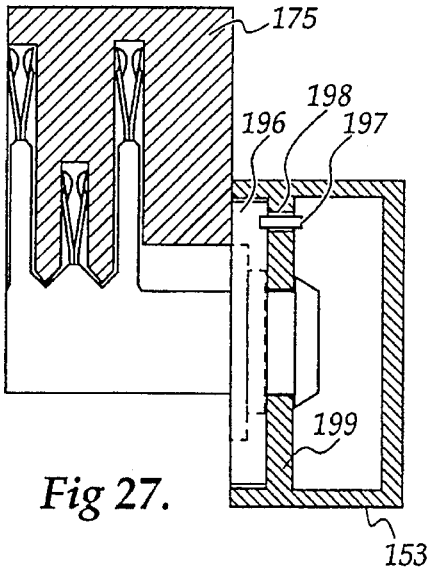

FIGS. 26 and 27 illustrate an alternative connector plug having a guard 175 mounted on a pivot 196 and attached to the connector plug to be free to rotate relative to the legs. In use the guide 174 both protects the tines and guides them during turning within the conductor assembly.

Figure 25:
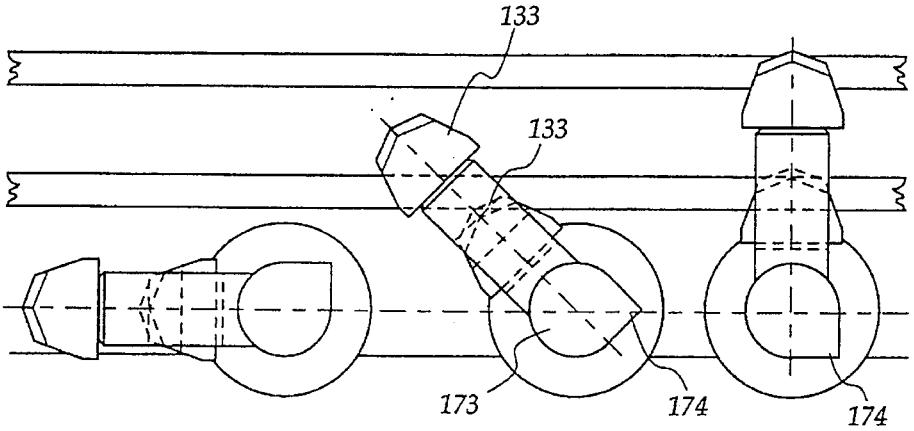
FIG. 25 illustrates the incremental electrical connection during rotation of the electrical connector plug.

As can be seen in FIG. 25 the arrangement is such that the earth conductor on leg 132 is engaged first during pivoting of the plug. Correspondingly during removal of the electrical connector plug from the electrical conductor assembly, the earth conductor is the last to be disengaged. Flange 173 provides a camming action which stops when right-angled stop 174 engages with a mating surface on the conductor assembly or skirting board whereby rotation of the plug beyond the 90° point is prevented. This is also facilitated by the provision of a pin 197 on pivot 196 which rotates with guard 175 within a quadrant arcuate slot 198 located in the wall 199 of plug housing 153. The slot is oriented so that the tines do not rotate through more than 90° from the disconnected to the connected positions.

Figure 28:
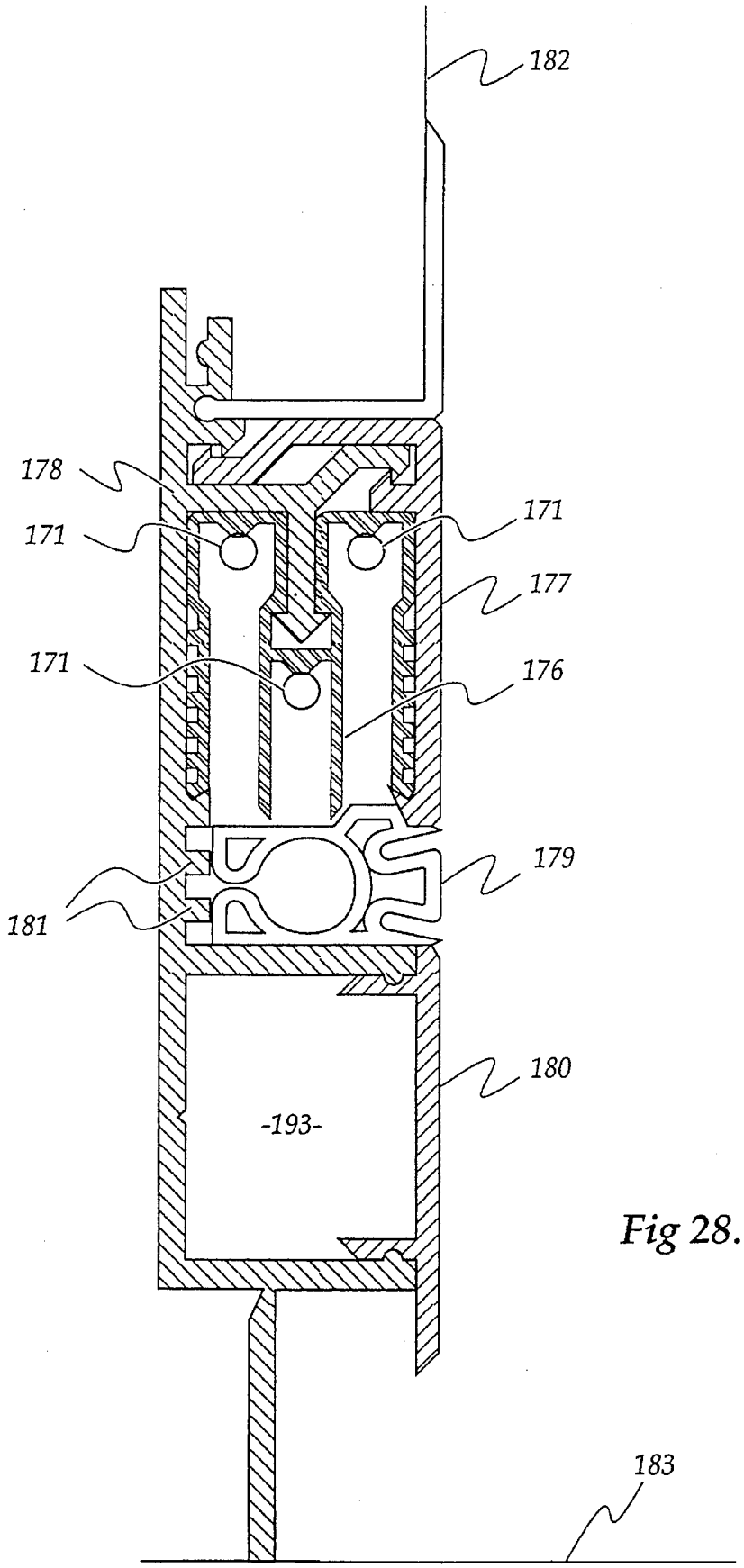
FIG. 28 is a cross-sectional elevation of an electrical distribution system located in a skirting board.

As can be seen in FIG. 28, the conductor assembly 176 is supported within skirting board support housing 178. Cover piece 177 supports the conductor assembly 176 and a cover strip 179 fits within an access channel beneath the conductor assembly 176 which, in use, receives the electrical connector plug. Duct cover 180 covers duct 193. Longitudinally extending ribs 181 are located on the interior wall of the housing 178 and serve to prevent inadvertent or accidental insertion of flexible objects into the housing. This enhances safety and guards against accidental electrocution of young children inserting electrically conductive material into the conductor assembly.

Figure 29:
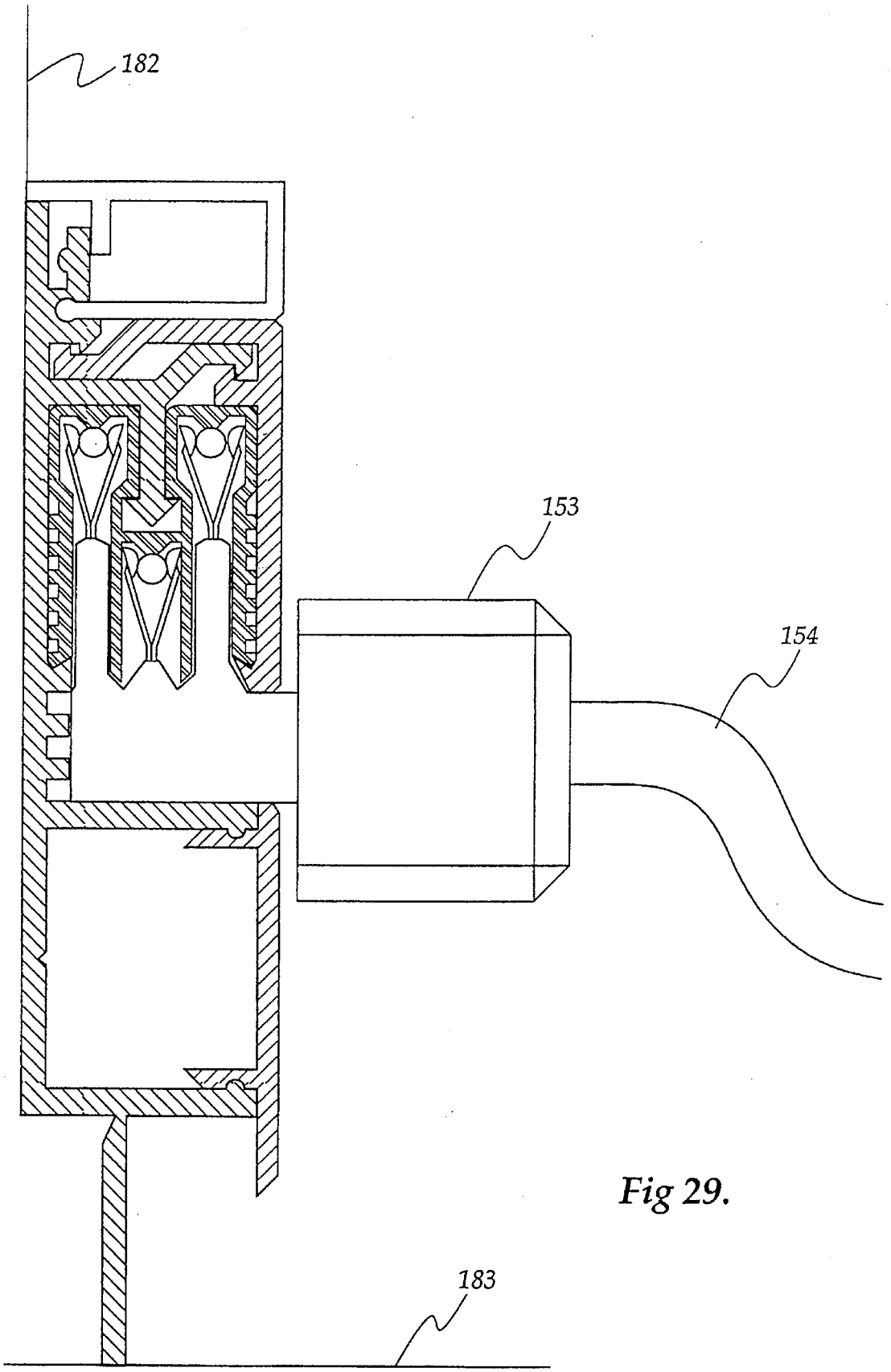
FIG. 29 is a cross-sectional elevation illustrating a plug connected in the electrical distribution system.

FIG. 29 illustrates a connector plug 153 positioned in the conductor assembly and rotated through 90° to establish electrical contact. The conductor assembly illustrated in FIG. 29 extends away from wall 182, in comparison with that illustrated in FIG. 28 where the assembly is flush with wall 182.

Figure 30:
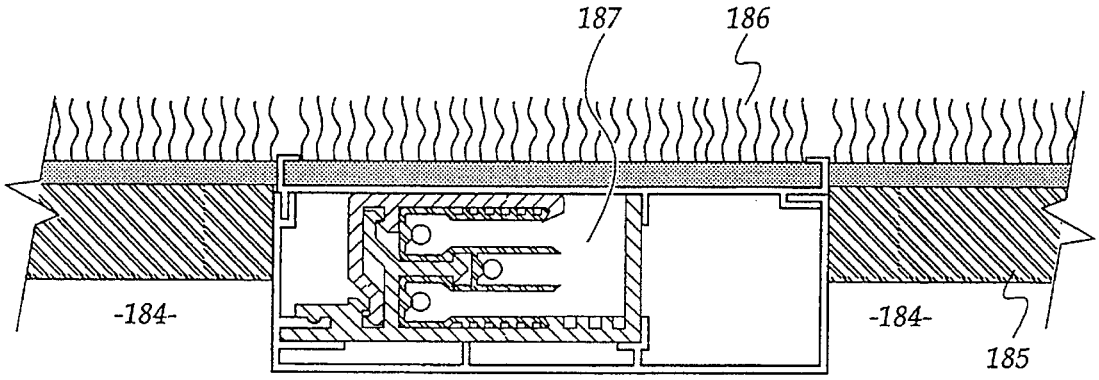
FIG. 30 illustrates an electrical distribution assembly located in a floor.

As can be seen in FIG. 30, a distribution assembly 187 may be located in the floor 184 to be flush with carpet 186 above underlay 185.

Figure 31:
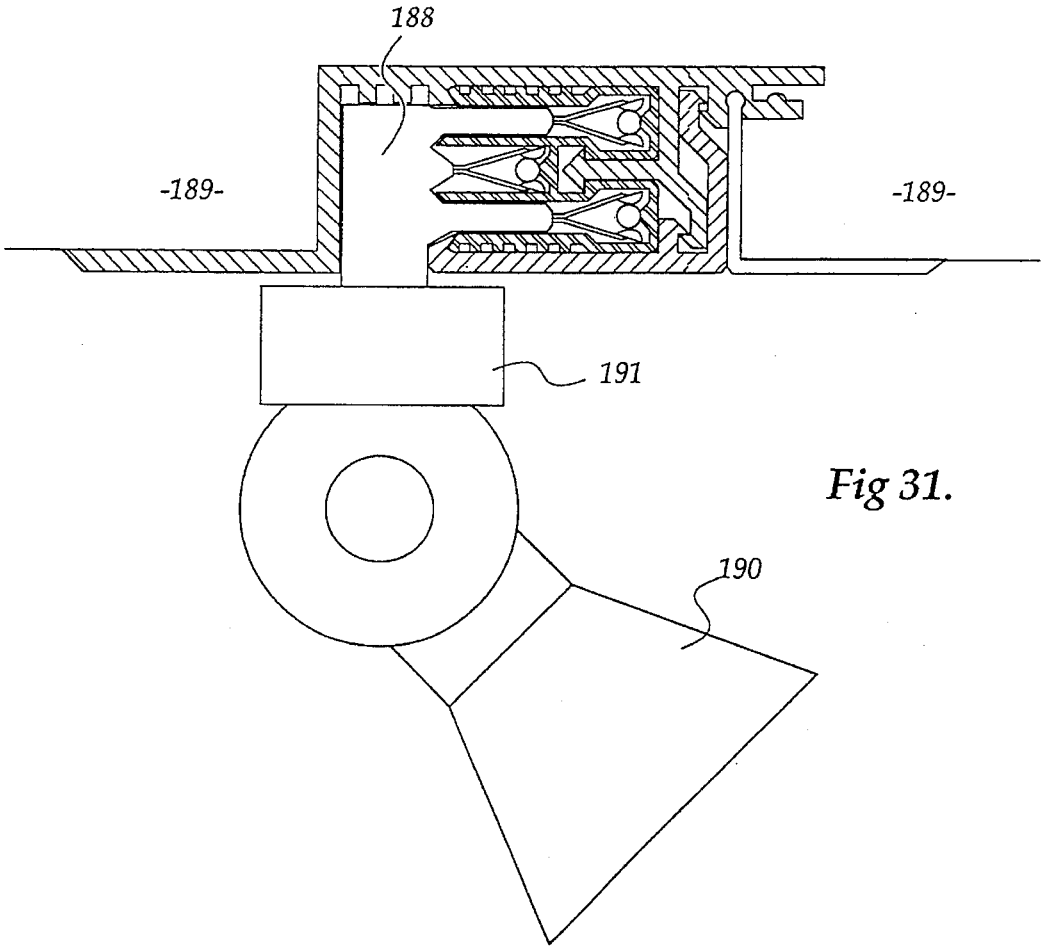

Alternatively, as seen in FIG. 31, a conductor assembly 188 may be located in ceiling 189 with connector plug 191 providing power to an electric light 190.

Figure 21:
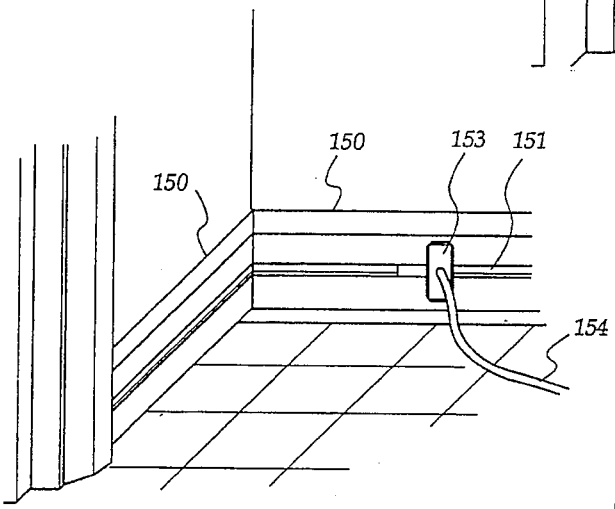
Figure 22:
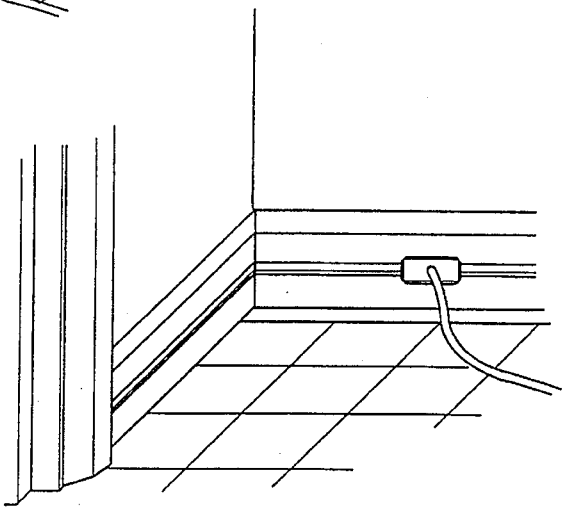

In use, as can be seen in FIGS. 19 to 22, flexible conductive track is located in skirting board 150. Cover strip is cut at 152 to leave a gap. Electrical connector plug 153 attached to electrical lead 154 is inserted in gap 152 as seen in FIG. 21 and rotated through 90° as seen in FIG. 22.

In use the adaptability of the flexible housing of the present invention to bend through an angle, typically through a right angle or other angles including a 180 degree return, avoids the requirement of prior art systems to cut and fit adaptors at the corners of a room. The continuity of the conductor assembly results in improved electrical characteristics and also simplifies installation thereby lowering material and labour installation costs.

The distribution system of the present invention provides a useful alternative to known systems. It is adaptable for use in floors and ceilings as well as skirting boards, and can be used as a light-track for lighting systems or for transmission of audio signals in sound systems. It will be appreciated that each of the above systems can be incorporated in a multi-chamber housing as illustrated in FIG. 12.

The distribution system can be a single or a multi-level cassette so that it is possible to add additional cassettes within a single housing to distribute a range of electrical services. For example power in one circuit, audio in another circuit and computer cabling in a third circuit. Furthermore, the wiping action of the tines over the conductors provides a self-cleaning effect and removes oxide from the conductor.

It will of course be realized that whilst the above has been given by way of an illustrative example of this invention, all such and other modifications and variations hereto, as would be apparent to persons skilled in the art, are deemed to fall within the broad scope and ambit of this invention as hereinafter claimed.

I claim:

1. An electrical distribution system including:

a support housing having at least one longitudinally extending chamber for receiving and supporting an electrical conductor assembly;

an electrical conductor assembly located in said chamber and spaced from a wall of said chamber to define a substantially continuous longitudinally extending access channel therewith, said conductor assembly including:

an elongage flexible insulated housing having a plurality of longitudinally extending substantially parallel slots extending inwardly from one face thereof and forming insulation means therebetween, and at least one longitudinally extending slot extending inwardly from a substantially opposite face thereof, said slot being substantially parallel to said plurality of slots, and elongate flexible conductor means located in at least one of the slots in said one face;

the arrangement being such that the width of said slots decrease when the conductor assembly is bent in a plane substantially perpendicular to the plane of said parallel slots; and at least one plug assembly having a plurality of plug conductors for establishing electrical contact with said conductor means, the arrangement being such that said plug conductors are receivable within said access channel to prevent said electrical contact being established and are rotatable within said access channel to establish said electrical contact.

2. An electrical distribution system as claimed in claim 1, wherein said plug assembly abuts said support housing and includes a projecting member receivable within said access channel when said plug assembly abuts said support housing, said plug conductors extending radially from said projecting member.

3. An electrical distribution system as claimed in claim 1, wherein said plug conductors include tines, recess means being located between said tines for closely receiving said insulating means.

4. An electrical distribution system as claimed in claim 1, and including a first longitudinally extending slot located substantially centrally in said opposite face and second and third longitudinally extending slots located off-centre in said one face.

5. An electrical distribution system as claimed in claim 4, wherein said chamber includes an engagement member for lockingly engaging in said first slot for supporting said insulated housing.

6. An electrical distribution system as claimed in claim 4, wherein said chamber includes rib or shoulder means for supporting said insulated housing.

7. An electrical distribution system as claimed in claim 4, and including a fourth longitudinally extending slot located substantially centrally in said one face.

8. An electrical distribution system as claimed in claim 7, wherein the slots in said one face include support means for supporting said conductor.

9. An electrical distribution system as claimed in claim 8, wherein said insulated housing is an extrusion.

10. An electrical distribution system as claimed in claim 1, wherein said conductor assembly includes a flexible elongate blade member in electrical contact with said conductor means for closely receiving a plug conductor and establishing electrical contact therewith.

11. An electrical distribution system as claimed in claim 10, wherein said elongate blade member is substantially U-shaped in cross-section and has a pair of opposed and inwardly biased substantially arcuate arms, the closed portion of said blade member housing said conductor means.

12. An electrical distribution system as claimed in claim 11, wherein said elongate blade member has a plurality of spaced cut-outs located along said closed portion.

13. An electrical distribution system as claimed in claim 1, wherein said plug assembly includes a support member from which said plurality of plug conductors extend radially, said plug conductors having socket means for establishing electrical contact with a respective conductor.

14. An electrical distribution system as claimed in claim 1, wherein one of said plug conductors makes electrical connection with an earthed conductor in said conductor assembly upon rotation of said plug assembly before the others of said plug conductors make electrical connection respectively with the others of said conductor means.

15. An electrical distribution system as claimed in claim 14, wherein said plug assembly includes rotation limiting means for preventing rotation of said plug assembly beyond an orientation wherein said plug conductors are substantially perpendicular to said conductor means.

16. An electrical distribution system as claimed in claim 15, wherein said rotation limiting means is a cam having stop means.

17. An electrical distribution system as claimed in claim 16, wherein said cam is a peripheral flange on said support member and said stop means is a tangential extension of the peripheral portion of said flange.

18. An electrical distribution system as claimed in claim 15, wherein said plug assembly includes a guard assembly pivotally mounted on said support member for pivoting from a position substantially encompassing said plug conductors upon engagement of said guard assembly with said conductor assembly upon rotation of said plug assembly.

19. An electrical distribution system as claimed in claim 18, wherein said said rotation limiting means includes a pin and a slot one of which is associated with said guard assembly for rotation therewith.

20. An electrical conductor assembly including:

an elongage flexible insulated housing having a plurality of longitudinally extending substantially parallel slots extending inwardly from one face thereof and forming insulation means therebetween, and at least one longitudinally extending slot extending inwardly from a substantially opposite face thereof and being substantially parallel to said plurality of slots; and elongate flexible conductor means located in at least one of the slots in said one face;

the arrangement being such that the width of said slots decrease when the conductor assembly is bent in a plane substantially perpendicular to the plane of said parallel slots.

* * * * *